US008429948B1

(12) United States Patent
Warren

(10) Patent No.: US 8,429,948 B1
(45) Date of Patent: Apr. 30, 2013

(54) TWISTING DEVICE FOR A PLURALITY OF ELECTRICAL WIRES AND METHOD OF USE THEREOF

(76) Inventor: Jon M. Warren, Bixby, OK (US)

( * ) Notice: Subject to any disclaimer, the term of this patent is extended or adjusted under 35 U.S.C. 154(b) by 174 days.

(21) Appl. No.: 12/839,953

(22) Filed: Jul. 20, 2010

(51) Int. Cl.
*B21D 43/26* (2006.01)

(52) U.S. Cl.
USPC ..... 72/409.13; 72/409.16; 140/117; 140/118; 140/123

(58) Field of Classification Search ..... 140/117, 140/118, 123, 149; 72/409.13, 409.16
See application file for complete search history.

(56) References Cited

U.S. PATENT DOCUMENTS

| | | | | | |
|---|---|---|---|---|---|
| 513,742 | A | | 1/1894 | Trout | |
| 515,799 | A | | 3/1894 | Smith | |
| 1,202,607 | A | | 10/1916 | Sweeny | |
| 1,324,583 | A | | 12/1919 | Carlson | |
| 2,032,415 | A | | 3/1936 | Hirsch | |
| 2,611,397 | A | * | 9/1952 | Limpus | 140/117 |
| 2,737,983 | A | * | 3/1956 | Pray | 140/118 |
| 3,092,152 | A | | 6/1963 | Neff | |
| 3,338,274 | A | * | 8/1967 | Harris | 140/118 |
| 3,357,460 | A | * | 12/1967 | Gawura | 140/106 |
| 3,385,326 | A | * | 5/1968 | Easton | 140/123 |
| 4,041,740 | A | * | 8/1977 | Villazon | 72/409.01 |
| 4,104,752 | A | | 8/1978 | Amrein et al. | |
| 4,386,461 | A | * | 6/1983 | Plummer | 29/749 |
| 4,486,937 | A | * | 12/1984 | Teramo | 29/268 |
| 4,607,544 | A | * | 8/1986 | Jewell, Jr. | 81/9.4 |
| 4,665,953 | A | * | 5/1987 | Randall | 140/118 |
| 5,084,935 | A | | 2/1992 | Kalthoff | |
| 5,245,721 | A | | 9/1993 | Lowe et al. | |
| 5,535,519 | A | | 7/1996 | Brimmer | |
| 5,651,283 | A | * | 7/1997 | Runciman et al. | 72/390.4 |
| 5,711,182 | A | | 1/1998 | Yang | |
| 6,029,297 | A | | 2/2000 | French | |
| 6,081,952 | A | | 7/2000 | Haxton | |
| 6,473,925 | B1 | * | 11/2002 | Konen | 7/107 |
| 6,588,039 | B1 | | 7/2003 | Bates | |
| D485,146 | S | | 1/2004 | Rivera | |
| D494,032 | S | | 8/2004 | Rivera | |
| 7,124,786 | B1 | * | 10/2006 | Gowhari | 140/118 |
| 7,350,393 | B2 | * | 4/2008 | Li | 72/409.16 |

OTHER PUBLICATIONS

Merriam-Webster Online Dictionary. Dec. 2, 1998. Definition for word "juxtaposed".*

* cited by examiner

*Primary Examiner* — Bena Miller
(74) *Attorney, Agent, or Firm* — Montgomery Patent & Design; Robert C. Montgomery

(57) ABSTRACT

A specialty tool to aid in twisting of up to six (6) individual wires for a cable assembly is herein disclosed, comprising a series of six (6) parallel channels perpendicular to the fulcrum line of the pliers. Each channel is sized to hold one (1) individual wire, facilitated by a one-way fixture that slightly penetrates the wires insulation thus holding it securely. Once the wires are in the tool, the jaws can be locked together and can be rotated in either direction to twist the wires. This procedure would be used with cable assembly during manufacturing processes.

15 Claims, 4 Drawing Sheets

TWISTING DEVICE FOR A PLURALITY OF ELECTRICAL WIRES AND METHOD OF USE THEREOF

RELATED APPLICATIONS

The present invention was first described in a notarized Official Record of Invention on Sep. 7, 2007, that is on file at the offices of Montgomery Patent and Design, LLC, the entire disclosures of which are incorporated herein by reference.

FIELD OF THE INVENTION

The present invention relates generally to the manipulation of wires and cable assemblies, and more particularly, to a specialty device to aid the twisting or separation of up to six (6) individual wires for a cable assembly.

BACKGROUND OF THE INVENTION

The field of electrical devices and systems, and in particular the design, arrangement, and manipulation of electrical wires and cable assemblies, is of great importance in the modern world. The twisting of multiple wires into cable assemblies and the corresponding separation of those cable assemblies into its constituent wires are important processes in this field of work. While these processes may be accomplished through a variety of means, including the use of the hands, dealing with such assemblies can be dangerous, difficult, and time consuming. This disadvantage is especially apparent in cases where the desired work area is difficult to access in some manner.

Various attempts have been made to provide for a means to more efficiently work with cable assemblies or a plurality of wires simultaneously. Examples of these attempts can be seen by reference to several U.S. patents. U.S. Pat. No. 1,324,583, issued in the name of Carlson, describes a wire twisting tool adapted to hold free adjacent wire ends. The Carlson tool provides a particular special relationship to allow for uniform twisting. U.S. Pat. No. 3,092,152, issued in the name of Neff, describes a wire twisting and cutting tool that grips a plurality of wires for twisting in a perpendicular manner. The Neff tool provides a cutting edge to trim the wires once the cable assembly is achieved. U.S. Pat. No. 7,124,786, issued in the name of Gowhari, describes linesman type pliers with a wire splice twister. The jaws provide a tapered recess to allow for wire insertion and a twisted splice when the pliers are manually rotated.

Additionally, ornamental designs for a wire twisting tool exist, particularly, U.S. Pat. Nos. D 485,146 and D 494,032. However, none of these designs are similar to the present invention.

While these devices fulfill their respective, particular objectives, each of these references suffer from one (1) or more disadvantages. Many of these devices are unfit to manipulate a plurality of wires. Those devices which are suited for manipulating a plurality of wires are not suited for the process of separating such cable assemblies. Furthermore, such devices are designed to grip a plurality of wires in a manner which is not perpendicular to the axis of twisting, thereby limiting the accessibility of use. Accordingly, there exists a need for a wire twisting device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a wire twisting device that is suitably adapted to manipulate a plurality of wires in a manner which is suitable for the processes of both assembling and separating cable assemblies and in a manner which is best suited for use in a variety of situations, particularly those situations in which access is limited in some manner. Thus, the object of the present invention is to solve the aforementioned disadvantages and provide for this need.

To achieve the above objectives, it is an object of the present invention to provide upper and lower jaw members wherein the aforementioned wires and cable assemblies may be inserted and manipulated. The jaws function in the manner of pliers inasmuch as their purpose is to secure a firm grip upon wires and cable assemblies.

Another object of the present invention is a plurality of pivoting members coupled to the upper and lower jaws. The pivoting members couple to the jaw members in a way such that the device functions in the manner of pliers, wherein the user may close the jaw members by manually gripping the pivoting members.

Yet still another object of the present invention is to provide a locking mechanism that is connected to the upper and lower jaw members. It is the purpose of the locking mechanism to allow the user to maintain the closed position of the upper and lower jaw members, once achieved, without continuous application of manual force.

Yet still another object of the present invention is to provide a plurality of channels formed within and between the upper and lower jaws, wherein these channels are linear and adapted to grip the electrical wires. The channels are oriented in a direction which is perpendicular to the pivoting axis.

Yet still another object of the present invention is a one-way fixture formed at the lower jaw and oriented perpendicular to the aforementioned channels. This one-way fixture is designed to bend downward when the upper and lower jaws are pressed together, in a manner which allows the wire to be guided freely along the channels.

Yet still another object of the present invention is to provide a method of utilizing the device that provides a unique means of assembling and separating a plurality of wires and cable assemblies in a manner which allows the user to do so quickly and easily and in cases in which access is limited in some way.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
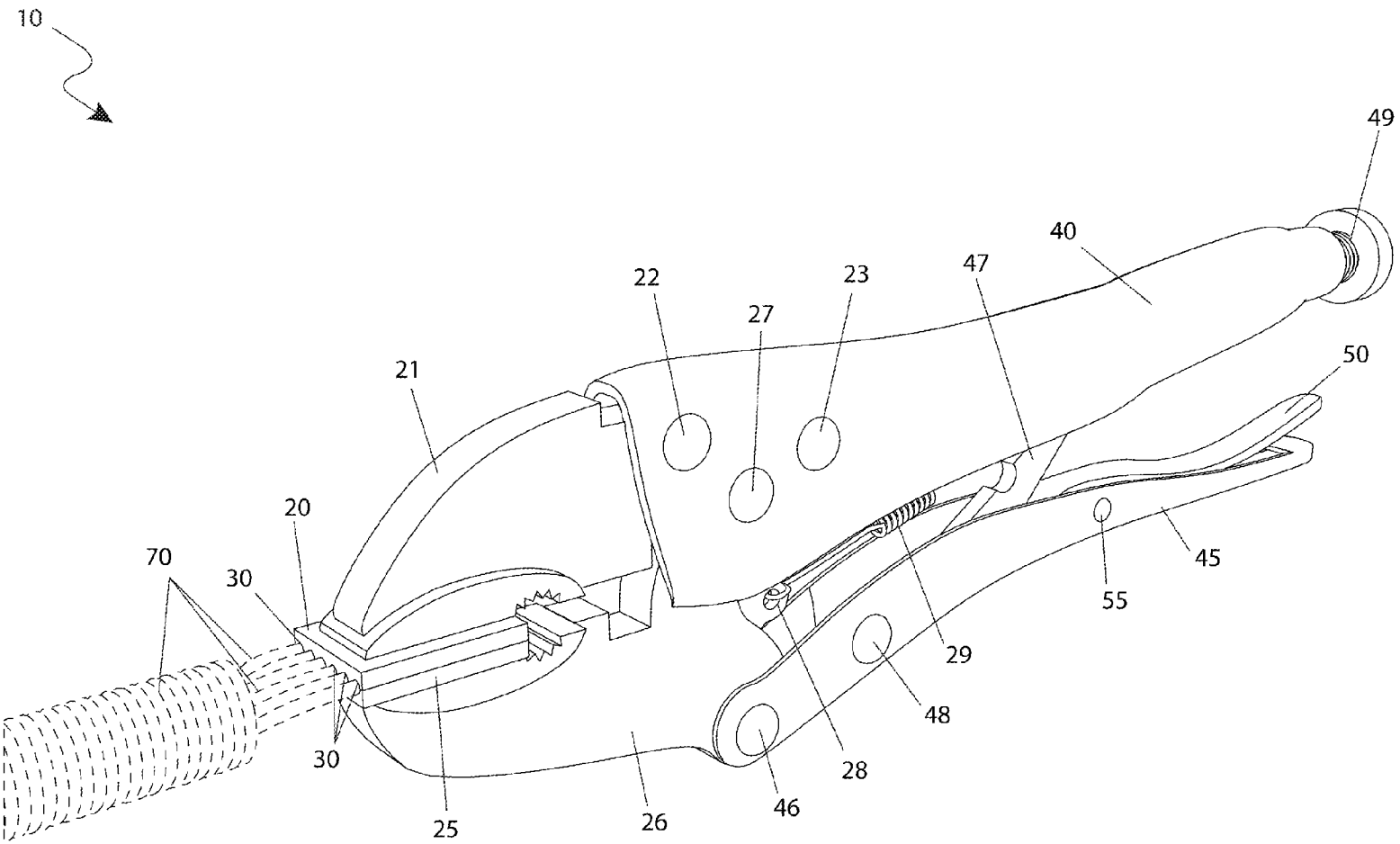
FIG. 1 is an in-use view of a twisting device for a plurality of wires 10, according to a preferred embodiment of the present invention.

| | |
|---|---|
| 10 | twisting device for a plurality of wires |
| 20 | upper jaw |
| 21 | upper mouth |
| 22 | first upper jaw anchor |
| 23 | second upper jaw anchor |
| 25 | lower jaw |
| 26 | lower mouth |
| 27 | lower jaw pivot point |
| 28 | spring aperture |
| 29 | spring |
| 30 | upper channel |
| 31 | lower channel |
| 35 | one-way fixture |
| 40 | upper member |
| 45 | lower member |
| 46 | lower member pivot point |
| 47 | adjustable link |
| 48 | adjustable link pivot point |
| 49 | adjusting screw |
| 50 | unlocking lever |
| 55 | unlocking lever pivot point |
| 70 | electrical wire |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a twisting device for a plurality of wires (herein described as the "device") 10, which provides a means for separating or twisting of up to six (6) individual electrical wires 70 preferably for a cable assembly. The device comprises an upper jaw 20, lower jaw 25, a pair of pivoting members, a locking mechanism, and a plurality of channels 30. This specialty portable hand tool possesses a similar body to that of pliers and would be utilized in many electrically dexterous trades and occupations.

Figure 2:
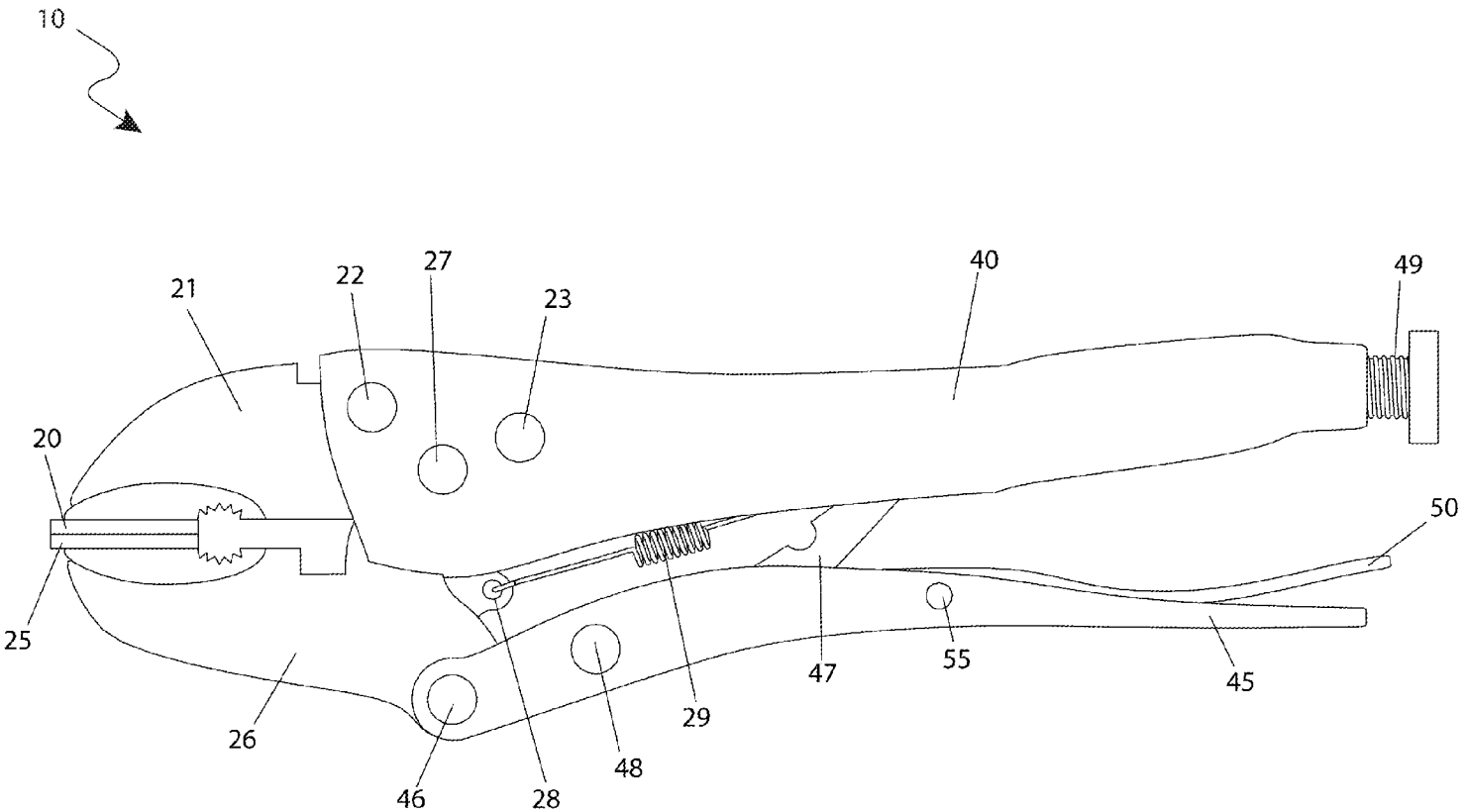
FIG. 2 is a side view of the twisting device for a plurality of wires 10, according to a preferred embodiment of the present invention.

Referring now to FIG. 1, an in-use view and FIG. 2, a side view of the device 10, according to the preferred embodiment of the present invention, are disclosed. The device 10 is depicting as comprising a conventional locking pliers-style style body comprising common features for illustration purposes only, it is known that other bodies may be utilized without limiting the scope of said device 10. The device 10 comprises an upper jaw 20 and lower jaw 25, thereby providing a means thereto grip electrical wires 70 therein a stationary position (also see FIGS. 3 and 4). The jaws 20, 25 are attached to an arcuate upper mouth 21 and an opposing arcuate lower mouth 26, respectively via fastening means such as integral forging, welding, or the like. The upper mouth 21 is attached to an upper member 40 via a first upper jaw anchor 22 and a second upper jaw anchor 23. The anchors 22, 23 are preferably standard pivoting rivets, yet other fastening means may be utilized without limiting the scope of the device 10. The upper member 40 provides an upper gripping means and the lower member 45 provides a lower gripping means, thereby enabling the user to grasp said device 10 for common operations. The lower mouth 26 is attached to a lower member 45 and the upper member 40 via a lower member pivot point 46 and a lower jaw pivot point 27, respectively, which enable the lower mouth 26 to be pivotally adjusted in a conventional manner. The lower member 45 provides a lower gripping means and houses an unlocking lever 50. The device 10 locks into position when the upper member 40 and lower member 45 are pressed toward each other simultaneously locking the jaws 20, 25 and mouths 21, 26 in a closed state as illustrated herein. The jaws 20, 25 and mouths 21, 26 are unlocked via pushing downwardly on the unlocking lever 50, thereby enabling said jaws 20, 25 and mouths 21, 26 to disengage. The unlocking lever 50 pivots about an unlocking lever pivot point 55 fastened to the lower member 55.

A spring 29 is attached between the upper member 40 and lower member 45 to enable the device 10 to open. The spring 29 is attached to a spring aperture 28 on a rear portion of the lower jaw 25. An adjustable link 47 is also attached between the upper member 40 and lower member 45, thereby providing a fulcrum point for said lower member 45. The adjustable link 47 protrudes from the upper member 45 and is attached to the lower member at the adjustable link pivot point 48, thereby enabling said lower member to operate. The gap between the mouths 21, 26 and concurrently the jaws 20, 25 is adjusted via an adjusting screw 49 which is threadably engaged to a rear proximal surface of the upper member 40. The adjusting screw 49 is rotated to cause each mouth 21, 26 to be opened at a desired distance, thereby enabling the gripping of the jaws 20, 25 to appropriately grip a desired electrical wire 70.

Figure 3:
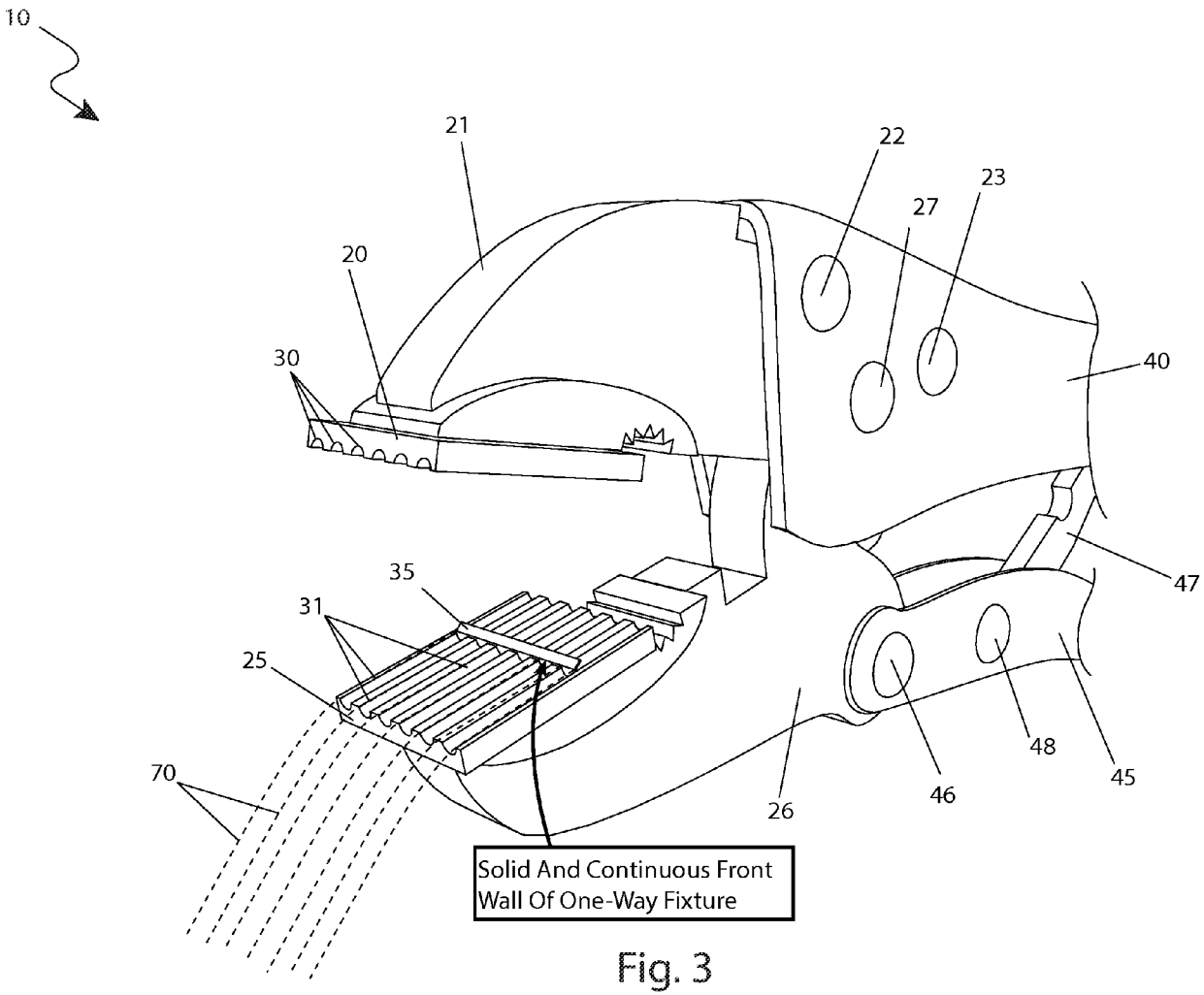
FIG. 3 is a perspective view of the twisting device for a plurality of wires 10 depicting an open state, according to the preferred embodiment of the present invention; and, FIG. 4 is a side cut-away view of the twisting device for a plurality of wires 10 depicting a wire placement, according to the preferred embodiment of the present invention.
Figure 4:
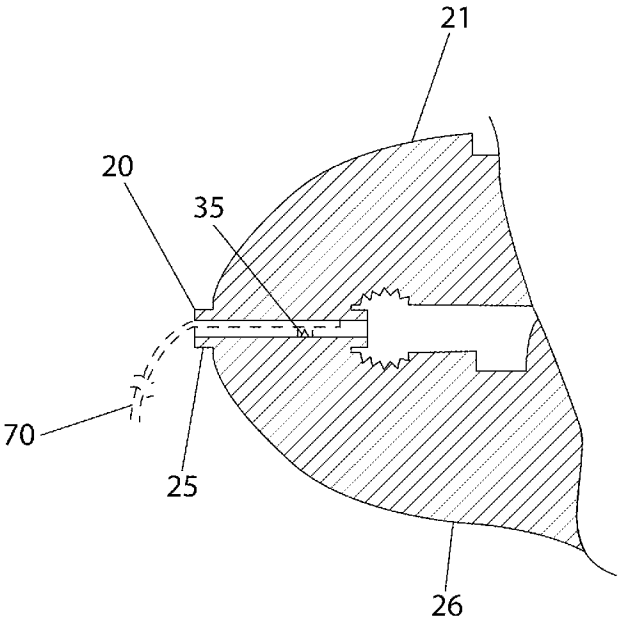

Referring now to FIG. 3, a perspective view of the device 10 depicting an open state and FIG. 4 a side cut-away view depicting a wire placement, according to the preferred embodiment of the present invention, are disclosed. The jaws 20, 25 comprise six (6) parallel channels 30 that are perpendicular to the pivoting axis of the device 10. Each channel 30 is sized to hold one (1) individual wire 70 thereby facilitating control thereto the unwieldy electrical wires 70. Each wire 70 slides freely as it is guided through the associated channel 30 and over a one-way fixture 35. The one-way fixture 35 resists opposite motion of the wires 70, thereby holding the wires 70 into place there by grazing and puncturing the underside of the wires 70. Once the electrical wires 70 are placed therein the device 10, the jaws 20, 25 can be pressed together which bends the one-way fixture 35 downward and releases the wires 70, as shown thereon FIG. 4.

When the jaws 20, 25 are completely closed they may be locked together by means of depressing the members 40, 45 toward each other. The locked state provides the device 10 with a closed position to hold the wires without the user holding said device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIGS. 1 through 4.

The method of installing and utilizing the device 10 may be achieved by performing the following steps: acquiring the device 10; adjusting the adjusting screw 49 to separate each mouth 21, 26 to a desired width; inserting at least one (1) and up to six (6) electrical wires 70 into an individual channel 30 and over-top the one-way fixture 35; pressing the upper member 40 and lower member 45 towards each other thereto close the jaws 20, 25 and secure the electrical wire 70 within the jaws 20, 25; rotating the device 10 in either direction thereto twist the electrical wires 70; unlocking the device 10, thereby pressing downwardly on the unlocking lever 50; removing the electrical wires 70 from the device 10; and, repeating if necessary.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hand-operable wire-twisting tool for simultaneously twisting a plurality of electrical wires in space-limited work areas, said hand-operable wire-twisting tool comprising:

an upper member having an upper jaw;

a lower member having a lower jaw;

a plurality of pivoting members coupled to said upper and lower jaws respectively;

a locking mechanism connected to said upper and lower jaws;

an unlocking mechanism connected to said upper and lower jaws for unlocking said locking mechanism;

a plurality of channels formed at said upper and lower jaws, said channels being linear and adapted to grip said plurality of electrical wires; and, a one-way fixture formed at said lower jaw and oriented perpendicular to said channels;

wherein said locking mechanism secures said upper jaw at a desired gap with respect to said lower jaw;

wherein said unlocking mechanism releases said upper jaw with respect to said lower jaw;

wherein said one-way fixture is bent downward when said upper and lower jaws are pressed together such that said plurality of electrical wires are freely guided along said channels;

wherein said upper and lower jaws are statically mated to said upper and lower members, respectively;

wherein each of said channels has a uniform length and width, respectively;

wherein said one-way fixture spans across an entire width of said lower jaw;

wherein said one-way fixture spans across each of said channels; and, wherein said one-way fixture has a continuous and solid front wall extending along an entire surface area thereof.

2. The hand-operable wire-twisting tool of claim 1, wherein said pivoting members are connected to each other at a pivoting axis.

3. The hand-operable wire-twisting tool of claim 2, wherein said channels are juxtaposed along said upper and lower jaws respectively such that said channels are oriented perpendicular to said pivoting axis.

4. The hand-operable wire-twisting tool of claim 1, wherein said upper and lower jaws are forged to said pivoting members.

5. The hand-operable wire-twisting tool of claim 1, wherein an upper one of said pivoting members is connected to said lower jaw, wherein a lower one of said pivoting members is connected to said upper jaw.

6. The hand-operable wire-twisting tool of claim 1, wherein each of said channels is adapted to hold one of said plurality of electrical wires.

7. The hand-operable wire-twisting tool of claim 1, further comprising:

a spring attached between said upper member and a spring aperture on said lower jaw;

an adjustable link protruding from said upper member and attached to an adjustable link pivot on said lower member;

an adjusting screw threadably engaged to a rear proximal surface of said upper member opposite said upper jaw;

an unlocking lever pivoting about an unlocking lever pivot point fastened to said lower member;

wherein said spring enables said tool to open;

wherein said adjustable link provides a fulcrum point for said lower member and sets said desired gap;

wherein said desired gap between said upper jaw and said lower jaw is selectively adjusted via said adjusting screw; and, wherein said unlocking lever operably contacts said adjustable link to unlock said upper jaw relative to said lower jaw.

8. The hand-operable wire-twisting tool of claim 1, wherein said tool comprises a locking pliers body.

9. A hand-operable wire-twisting tool for simultaneously twisting a plurality of electrical wires in space-limited work areas, said hand-operable wire-twisting tool comprising a locking pliers body further comprising:

an upper member having an upper jaw;

a lower member having a lower jaw;

a plurality of pivoting members coupled to said upper and lower jaws respectively;

a locking mechanism connected to said upper and lower jaws;

an unlocking mechanism connected to said upper and lower jaws for unlocking said locking mechanism;

a plurality of channels formed at said upper and lower jaws, said channels being linear and adapted to grip said plurality of electrical wires; and, a one-way fixture formed at said lower jaw and oriented perpendicular to said channels, said one-way fixture being adapted to resist linear motion of said plurality of electrical wires by grazing and puncturing an underside portion of said plurality of electrical wires;

wherein said one-way fixture is bent downward when said upper and lower jaws are pressed together;

wherein said one-way fixture is adapted to freely guide the electrical wires along said channels when said upper and lower jaws are pressed together;

wherein said upper and lower jaws are statically mated to said upper and lower members, respectively;

wherein each of said channels has a uniform length and width, respectively;

wherein said one-way fixture spans across an entire width of said lower jaw;

wherein said one-way fixture spans across each of said channels;

wherein said one-way fixture has a continuous and solid front wall extending along an entire surface area thereof.

10. The hand-operable wire-twisting tool of claim 9, wherein said pivoting members are connected to each other at a pivoting axis.

11. The hand-operable wire-twisting tool of claim 10, wherein said channels are juxtaposed along said upper and lower jaws respectively such that said channels are oriented perpendicular to said pivoting axis.

12. The hand-operable wire-twisting tool of claim 9, wherein said upper and lower jaws are forged to said pivoting members.

13. The hand-operable wire-twisting tool of claim 9, wherein an upper one of said pivoting members is connected to said lower jaw, wherein a lower one of said pivoting members is connected to said upper jaw.

14. The hand-operable wire-twisting tool of claim 9, wherein each of said channels is adapted to hold one of said plurality of electrical wires.

15. The hand-operable wire-twisting tool of claim 9, further comprising:

a spring attached between said upper member and a spring aperture on said lower jaw;

an adjustable link protruding from said upper member and attached to an adjustable link pivot on said lower member;

an adjusting screw threadably engaged to a rear proximal surface of said upper member opposite said upper jaw;

an unlocking lever pivoting about an unlocking lever pivot point fastened to said lower member;

wherein said spring enables said tool to open;

wherein said adjustable link provides a fulcrum point for said lower member and sets said desired gap;

wherein said desired gap between said upper jaw and said lower jaw is selectively adjusted via said adjusting screw; and, wherein said unlocking lever operably contacts said adjustable link to unlock said upper jaw relative to said lower jaw.

* * * * *